US006010542A

United States Patent [19]

DeYoung et al.

[11] Patent Number: 6,010,542

[45] Date of Patent: Jan. 4, 2000

[54] METHOD OF DYEING SUBSTRATES IN CARBON DIOXIDE

[75] Inventors: James P. DeYoung, Durham; James B. McClain, Raleigh; Joseph M. DeSimone, Chapel Hill; Timothy J. Romack, Durham, all of N.C.

[73] Assignee: Micell Technologies, Inc., Raleigh, N.C.

[21] Appl. No.: 09/141,488

[22] Filed: Aug. 28, 1998

Related U.S. Application Data

[60] Provisional application No. 60/057,063, Aug. 29, 1997.

[51] Int. Cl.[7] ..... D06P 5/00; D06P 1/52

[52] U.S. Cl. ..... 8/474; 8/475; 8/495; 8/552; 8/581; 8/615; 8/654; 8/532; 8/917; 8/918; 8/922; 8/676

[58] Field of Search ..... 8/474, 475, 618, 8/916–927, 637, 676, 654, 657, 495, 581, 615, 552, 532

[56] References Cited

U.S. PATENT DOCUMENTS

| | | | |
|---|---|---|---|
| 4,314,815 | 2/1982 | Mollet . | |
| 5,030,245 | 7/1991 | Hemling . | |
| 5,199,956 | 4/1993 | Schlenker et al. | 8/473 |
| 5,250,078 | 10/1993 | Saus et al. | 8/475 |
| 5,295,998 | 3/1994 | Merritello et al. . | |
| 5,298,032 | 3/1994 | Schlenker et al. . | |
| 5,506,317 | 4/1996 | DeSimone et al. | 526/201 |
| 5,512,058 | 4/1996 | Gavend et al. | 8/94.18 |
| 5,578,088 | 11/1996 | Schrell et al. | 8/475 |
| 5,683,473 | 11/1997 | Jureller et al. | 8/142 |
| 5,683,977 | 11/1997 | Jureller et al. | 510/286 |
| 5,789,505 | 8/1998 | Wilkinson et al. | 526/209 |

FOREIGN PATENT DOCUMENTS

| | | | |
|---|---|---|---|
| 43 32 219 A1 | 3/1994 | Germany | D06P 1/16 |
| 44 29 470 A1 | 3/1995 | WIPO | D06P 5/04 |
| Wo 97/16264 | 5/1997 | WIPO . | |

OTHER PUBLICATIONS

Clifford et al.; Supercritical Fluid Dyeing, *Textile Technology International*, 3 pgs. (1995).

*Primary Examiner*—Margaret Einsmann
*Attorney, Agent, or Firm*—Myers Bigel Sibley & Sajovec

[57] ABSTRACT

A method of dyeing a substrate in carbon dioxide comprises the steps of (a) providing a dye composition comprising carbon dioxide, a dye, and a surfactant, the surfactant included in an amount sufficient to solubilize, emulsify or disperse the dye in the carbon dioxide; and then (b) dyeing said substrate with said dye composition.

54 Claims, No Drawings

METHOD OF DYEING SUBSTRATES IN CARBON DIOXIDE

This application claims priority from Provisional Application Ser. No. 60/057,063, filed Aug. 29, 1997, the disclosure of which is incorporated by reference herein in its entirety.

FIELD OF THE INVENTION

The present invention relates to methods of dyeing substrates, particularly fibers, yarns and fabrics, in carbon dioxide.

BACKGROUND OF THE INVENTION

Textile materials are typically dyed with an aqueous dye liquor. In such techniques, a complete bath exhaustion rarely occurs: that is, the dyes do not exhaust quantitatively onto the respective substrate. Thus, after the dyeing process, the residual dye liquor may still contain a large amount of dye. As a result, dyeing produces large amounts of colored effluents which must be purified at considerable time and expense.

The dyeing of substrate materials in liquid or supercritical $CO_2$ has been disclosed. See, e.g., A. Clifford and K. Bartle, *Textile Technology International*, 113 (1995); U.S. Pat. No. 5,578,088 to Schrell et al.; U.S. Pat. No. 5,512,058 to Gavend et al.; U.S. Pat. No. 5,298,032 to Schlenker et al.; U.S. Pat. No. 5,250,078 to Saus et al.; U.S. Pat. No. 5,199,956 to Schlenker et al.; and German Offenlegungschrift DE 4429470A1.

Processes for carbon dioxide dyeing currently available are not entirely satisfactory, and there is a continued need for new ways to carry out the dyeing of substrates in carbon dioxide.

SUMMARY OF THE INVENTION

The present invention provides methods of dyeing substrates, particularly fibers. yarns and fabrics, in carbon dioxide in the presence of a surfactant, with the surfactant included to solubilize or emulsify the dye in the carbon dioxide.

Accordingly, a first aspect of the present invention is a method of dyeing a substrate in carbon dioxide comprises the steps of (a) providing a dye composition comprising carbon dioxide, a dye, and a surfactant, the surfactant preferably included in an amount sufficient to solubilize, emulsify or disperse the dye in the carbon dioxide; and then (b) dyeing said substrate with said dye composition. The dye composition may optionally contain water.

A second aspect of the present invention is a method of dyeing and surface treating, a substrate in carbon dioxide. The method comprises the steps of (a) providing a dye composition comprising carbon dioxide, a dye, a surfactant, and a surface treatment component, the surfactant preferably included in an amount sufficient to solubilize, emulsify or disperse said dye in said carbon dioxide; and then (b) dyeing said substrate with said dye composition so that said substrate is dyed and said surface treatment component is deposited on the surface of said substrate. The surface treatment component may be one which lowers the surface tension of the substrate (for example, to impart water and/or stain resistance to the substrate). Again, the dye composition may optionally contain water.

The foregoing and other objects and aspects of the present invention are explained in detail below.

DETAILED DESCRIPTION OF THE INVENTION

Dyes that may be used to carry out the present invention include, but are not limited to, azo (mono, di, poly), carbonyl, sulfur, methine, and triarylcarbonium dyes. The dyes may be anionic (acid including non-metallized acid, mordant, direct, reactive), cationic, (brilliant color with good color fastness), direct (substantive character without mordants), dispersive (very low solubility in dyebath, substantive toward hydrophobics), and azoid (azo containing small molecule permeation followed by a reaction to form a larger substantive dye) dyes.

Materials that may be dyed by the methods of the present invention include, but are not limited to, fiber, yarns and fabrics formed from polyester, nylon, acrylic fibers, acetate (particularly cellulose acetate), cotton, and wool, including blends thereof such as cotton/polyester blends, as well as leather. In particular, textile substrates are treated by the process, and encompass a larger number of materials. Such substrates are those formed from textile fibers and precursors and include, for example, fabrics, garments, upholstery, carpets, tents, canvas, leather, clean room suits, parachutes, yarns, fibers, threads, footwear, silks, and the other water sensitive fabrics. Articles (e.g., ties, dresses, blouses, shirts, and the like) formed of silk or acetate are particularly well suited for treatment by the process of the invention.

Surfactants termed "$CO_2$/Dye-philic" are specifically designed and formulated materials that possess substantive affinity for dye molecules and conjunctive affinity for liquid and/or supercritical carbon dioxide. Said materials are designed to facilitate the dyeing of synthetic and natural fibers in carbon dioxide media by altering the state of the dye in the bath, and/or by affecting a physical interaction of the surfactant material with the fiber. Existing carbon dioxide based dyeing technologies designed for synthetic fibers typically require elevated temperature and pressure regimes that will affect the dissolution of dyes in $CO_2$, and their transport through the synthetic fibers. These technologies limit the choice of dyes to non-ionic containing molecules with significant vapor pressure, typically disperse dyes. Larger and less volatile dyes, as well as ionic containing dyes, such as acid dyes, have not been shown to be useful in carbon dioxide mediated dyeing systems. Furthermore, existing processes utilizing disperse dyes in $CO_2$ require high temperatures and pressures for sufficient dissolution of the dye. The current invention reduces these requirements substantially. Examples of suitable surfactants include, but are not limited to, those described in U.S. Pat. No. 5,506,317 to DeSimone, the disclosure of which is incorporated herein by reference.

The carbon dioxide may be in liquid or supercritical form, but is preferably at a temperature under 100° C. and a pressure under 3500 psi.

The carbon dioxide-containing composition used in the process of the invention may be employed in a single or multi-phase system with appropriate and known liquid components. Such components generally include, but are not limited to, a co-solvent or modifier, a surfactant, a co-surfactant, and other additives such as bleaches, optical brighteners, enzymes, rheology modifiers, sequestering agents, chelants, biocides, antiviral agents, fungicides, acids, polishes, radical sources, plasma, deep UV (photoresist) materials, crosslinking agents (e.g., difunctional monomers), metal soaps, sizing agents, antistatics, antioxidants, UV stabilizers, whiteners fabric softener builders, detergents, dispersants, hydrotropes, and mixtures thereof. Any or all of the components may be employed in the process of the present invention prior to, during. or after the substrate is contacted by the $CO_2$ fluid.

For the purposes of the invention, multi-phase systems refers to processes in which the substrate may be treated in the fluid that contains a solid or fluid phase other than a carbon dioxide fluid phase. Other components in such systems include, for example, water under carbon dioxide head pressure which may be instrumental in lowering the $T_g$ in of a substrate and, in certain instances, may be needed for chemical reasons; immisible liquids; and head pressurizing gases, the selection of which is known in the art.

Various surface treatment components may be used in the process of the present invention. The surface treatment components preferably impart stain resistance to the substrate. A surface treatment component is a material which is entrained in the fluid so as to treat the surface of the substrate and lower the surface tension of the substrate as set forth herein. The term "treat" should be broadly interpreted and encompass the surface treatment component coating or impregnating of the substrate surface. If desired, the surface active component may polymerize on the surface, or may be grafted onto the surface. Suitable surface treatment components include, but are not limited to, various monomer and polymer materials. Exemplary monomers include those which may be reactive or non-reactive, and contain fluorinated groups, siloxane groups or mixtures thereof.

Polymers which are employed as surface treatment components may encompass those which contain a segment which has an affinity for carbon dioxide ("$CO_2$-philic") along with a segment which does not have an affinity for carbon dioxide ("$CO_2$-phobic") which may be covalently joined to the $CO_2$-philic segment. Reactive and non-reactive polymers may be used. Exemplary $CO_2$-philic segments may include a fluorine-containing segment, a siloxane-containing segment, or mixtures thereof.

The fluorine-containing segment is typically a "fluoropolymer". The term "fluoropolymer," as used herein, has its conventional meaning in the art. *See generally Fluoropolymers* (L. Wall, Ed. 1972)(Wiley-Interscience Division of John Wiley & Sons); see also *Fluorine-Containing Polymers*, 7 Encyclopedia of Polymer Science and Engineering 256 (H. Mark et al. Eds., 2d Ed. 1985), that are formed from the polymerization of fluoromonomers. The term "fluoromonomer" refers to fluorinated precursor monomers which make up the fluoropolymers. Any suitable fluoromonomer may be used in forming the fluoropolymers, including, but not limited to, fluoroacrylate monomers, fluoroolefin monomers, fluorostyrene monomers, fluoroalkylene oxide monomers (e.g., perfluoropropylenie oxide, perfluorocyclohexene oxide), fluorinated vinyl alkyl ether monomers, and the copolymers thereof with suitable comonomers, wherein the comonomers are fluorinated or unfluorinated.

Surface treatment components which are suitable for the invention may be in the form of, for example, random, block (e.g., di-block, tri-block, or multi-block), blocky (those from step growth polymerization), and star homopolymers, tapered polymers, tapered block copolymers, gradient block copolymers, other copolymers, and co-oligomers. Exemplary surface treatment components include, but are not limited to, poly(1,1-Dihydroperfluorooctyl methacrylate) ("poly FOMA"); (1,1-Dihydroperfluorooctyl methacrylate)-co-methyl methacrylate ("FOMA-co-MMA"); (1,1-Dihydroperfluorooctyl methacrylate)-block-methyl methacrylate ("FOMA-block-MMA"); PTA-N; TA-N/PEG; PDMS-PEG; poly(1,1,2,2-tetrahydro perfluoroalkyl acrylates); poly(1,1,2,2-tetrahydro perfluoroalkyl methacrylates); poly(1,1-dihydro perfluoroalkyl acrylates); poly(1,1-dihydro perfluoroalkyl methacrylates); poly(1,1,2,2,3,3-hexahydro perfluoroalkyl acrylates); and poly (1,1,2,2,3,3-hexahydro perfluoroalkyl methacrylates). For the purposes of the invention, two or more surface treatment components may be employed in the fluid containing carbon dioxide.

Other surface treatment components may be used which do not have distinct $CO_2$ philic and $CO_2$ phobic segments, e.g., perfluoropolymers. Exemplary surface treatment components which may be used include, but are not limited to, those described in Rao et al., *Textile Finishes* and *Fluorosurfactanis*, Organofluorine Chemistry: Principals and Commercial Applications, Banks et al. (eds.) Plenum Press, New York (1994).

The surface treatment component may be applied in various amounts. In the instance where the component is applied as a low level surface treatment, it is preferred to employ the surface treatment component such that the weight of the substrate is less than about 5 percent of surface treatment component, and more preferably less than about 1 weight percent. In the instance where the surface treatment component is applied as a high level surface treatment, it is preferred that the surface treatment component is employed in amounts such that the weight of the substrate is greater than about 2 weight percent of surface treatment component.

Other additives may be employed with the carbon dioxide, preferably enhancing the physical or chemical properties of the fluid or acting on the substrate. Such additives may include, but are not limited to, bleaching agents, optical brighteners, bleach activators, corrosion inhibitors, enzymes, builders, co-builders, chelants, sequestering agents, and rheology modifiers. Mixtures of any of the above may be used. As an example, rheology modifiers are those components which may increase the viscosity of the fluid. Exemplary polymers include, for example, perfluoropolyethers, fluoroalkyl polyacrylics, and siloxane oils, including those which may be employed as rheology modifiers. Additionally, other molecules may be employed including $C_1$–$C_{10}$ alcohols, $C_1$–$C_{10}$ branched or straight-chained saturated or unsaturated hydrocarbons, ketones, carboxylic acids, N-methyl pyrrolidone, dimethylacetyamide, ethers, fluorocarbon solvents, and chlorofluorocarbon solvents. For the purposes of the invention, the additives are typically utilized up to their solubility limit during the contacting of the substrate.

The surface tension of the substrate is lowered as a result of applying the surface treatment component. Preferably, the surface tension is lowered by a value of 10 percent, and more preferably the surface tension is lowered by a value of 25 percent. The level of reduction can be on the order of 1 dyne/sq cm. Thus, for example, when the surface treatment component is applied to fabric or textile substrates, the lowering of surface tension imparts stain and/or water resistance to the substrate.

A surfactant or co-surfactant in addition to the surfactant employed to solubilize or emulsify the dye may be used in the fluid to enhance the efficacy of the surface treatment component. Suitable surfactants or co-surfactants are those materials which typically modify the action of the surface treatment component, for example, to enhance contact of the surface treatment component with the substrate.

Exemplary co-surfactants that may be used include, but are not limited to, longer chain alcohols (i.e., greater than $C_8$) such as octanol, decanol, dodecanol, cetyl, laurel, and the like; and species containing two or more alcohol groups or other hydrogen bonding functionalities; amides; amines; and other like components. Potentially surface active which also may be employed as co-surfactants include, but are not limited to, fluorinated small molecules, fluorinated acrylate monomers (e.g., hydrogenated versions), fluorinated alcohols and acids, and the like. Suitable other types of materials that are useful as co-surfactants are well known by those skilled in the art, and may be employed in the process of the present invention. Mixtures of the above may be used.

A co-solvent may optionally be included in the composition. Examples of suitable co-solvents or modifiers include, but are not limited to, liquid solutes such as alcohols (e.g., methanol, ethanol, and isopropanol); fluorinated and other halogenated solvents (e.g., chlorotri- fluoromethane, trichlorofluoromethane, perfluoropropane, chlorodifluoromethane, and sulfur hexafluoride); amines (e.g., N-methyl pyrrolidone); amides (e.g., dimethyl acetamide); aromatic solvents (e.g., benzene, toluene, and xylenes); esters (e.g., ethyl acetate, dibasic esters, and lactate esters); ethers (e.g., diethyl ether, tetrahydrofuran, and glycol ethers); aliphatic hydrocarbons (e.g., methane, ethane, propane, ammonium butane, n-pentane, and hexanes); oxides (e.g., nitrous oxide); olefins (e.g., ethylene and propylene); natural hydrocarbons (e.g., isoprenes, terpenes, and d-limonene); ketones (e.g., acetone and methyl ethyl ketone); organosilicones; alkyl pyrrolidones (e.g., N-methyl pyrrolidone); paraffins (e.g., isoparaffin); petroleum-based solvents and solvent mixtures; and any other compatible solvent or mixture that is available and suitable. Mixtures of the above co-solvents may be used. The above components can be used prior to, during, or after the substrate is contacted by the $CO_2$ fluid.

The process of the invention may be carried out using apparatus and techniques known to those skilled in the art. The process typically begins by providing a substrate in an appropriate pressurized system (e.g., vessel) such as, for example, a batchwise or semi-continuous system. The surface treatment component is also usually added to the vessel at this time. The fluid containing carbon dioxide is then typically added to the vessel and the vessel is heated and pressurized. The dye, surfactant, and surface treatment component and the fluid may be added to the vessel simultaneously, if so desired. Additives (e.g., co-solvents, co-surfactants, and the like) may be added at an appropriate time. After charging the vessel with the fluid containing carbon dioxide, the fluid contacts the substrate, and dye and the surface treatment component treats the substrate while concurrently dyeing the substrate. During this time, the vessel is preferably agitated by known techniques including, for example, mechanical agitation; sonic, gas, or liquid jet agitation; pressure pulsing; or any other suitable mixing technique.

The surfactant may be included in any suitable amount (e.g., from 0.01, 0.05, 0.1 or 0.5 to 5, 10, 20, or 30 percent by weight of the dye composition), and the dye may be included in any suitable amount (e.g., from 0.001, 0.005, 0.01, 0.05, 0.1, or 0.5, to 5, 10, 15, or 20 percent by weight of the dye composition). The carbon dioxide will typically be at least 30 percent by weight of the dye composition). If included, water may be included in any suitable amount (e.g., from 0.1, 1 or 2 to 5, 10, 20, 30 or 40 or more percent by weight of the dye composition). The surface treatment component, when included, may be included in any suitable amount amount (e.g., from 0.01, 0.05, 0.1 or 0.5 to 5, 10, 20, or 30 percent by weight of the dye composition).

The present invention is explained in greater detail in the following non-limiting examples.

EXAMPLE 1

0.150 grams of dry disperse blue 77 dye is added to 40 grams of a $CO_2$/dye-philic surfactant comprised of a polydimethylsiloxane (PDMS) polymer with a number average molecular weight of 1200 g/mole that is end terminated with 3-([2-hydroxy-3-diethylamino] propoxy) propane groups. The Blue dye is evenly dispersed in the surfactant by stirring the mixture at 60° C. The surfactant dye mixture is added to an 800 cc autoclave with a magnetically coupled stirrer containing a 15 gram swatch of polyester fiber. The autoclave is charged with $CO_2$ to compressed liquid full conditions (1150 psi; 25° C.). the mixture is stirred and the temperature of the autoclave is raised at a rate of 2° C./minute to 60° C. The autoclave is maintained under steady state conditions at approximately 60° C. and 3300 psi for 30 minutes, at which point the heating is cased and the reactor is slowly cooled to 25° C. using an external cooling loop (~25 minutes). The carbon dioxide is slowly vented from the autoclave and the dyed blue fabric is removed.

EXAMPLE 2

0.150 grams of a dry disperse dye is added to 40 grams of a $CO_2$/dye-philic surfactant that is comprised of a PDMS polymer containing containing aliphatic units with functional groups consisting of a tertiary amine, a hydroxyl group, and an ether linkage. Dyeing of PET fiber or fabric is then carried out under similar conditions to those described in Example 1.

EXAMPLE 3

A method is carried out as in example 1 or 2 that incorporates a PDMS copolymer surfactant. Non-PDMS units consist of aliphatic or aromatic units with functional groups containing 1 or more of the following groups: amine, amide, imide, ester, ether, hydroxyl, ketones, azide, urethane, nitrile, nitroso-, cyano-, phenol, sulfonyl, whereby polyester fiber or fabric is dyed with a disperse dye.

EXAMPLE 4

A method as in example 3 which incorporates a block copolymer consisting of a $CO_2$-philic PDMS block and a dye-philic block comprised of aliphatic and or aromatic units with functional moieties as described in example 3.

EXAMPLE 5

A method as described in example 1 that incorporates a surfactant consistent with those described in EXAMPLE 3 or EXAMPLE 4, and a disperse dye is used to dye a polyester/cotton blended fabric.

EXAMPLE 6

A method as described in example 5 is used to dye cotton yarn or fabric with a disperse dye.

EXAMPLE 7

A method as described in example 5 is used to dye nylon fiber or fabric with a disperse dye.

EXAMPLE 8

A method as described in example 5 is used to dye acetate fiber or fabric with a disperse dye.

EXAMPLE 9

0.0.100 grams of CI Acid Red 138 dye is added to an 800 cc autoclave with 40 grams of a surfactant consistent with those described in EXAMPLE 3 or EXAMPLE 4, and a 5 gram swatch of nylon cloth. 15.0 grams of water and $C0_2$ sufficient to bring the vessel to liquid full conditions (1100 psi, 25° C.) are charged to the vessel as vigorous stirring is initiated. The temperature of the vessel is gradually raised (2° C./minute) to 60° C. at which point the system is maintained under adiabatic conditions for 20 minutes. The vessel is cooled to 25° C. using an external cooling loop and the pressure is slowly reduced to atmospheric levels at which point the red cloth is removed from the vessel.

EXAMPLE 10

A method as described in EXAMPLE 9 is used to dye nylon fiber or fabric with non-metallized Acid dyes.

EXAMPLE 11

A method as described in EXAMPLE 9 is used to dye wool fibers or fabric with nonmetallized Acid dyes.

The foregoing is illustrative of the present invention, and is not to be construed as limiting thereof. The invention is defined by the following claims, with equivalents of the claims to be included therein.

That which is claimed is:

1. A method of dyeing a substrate in carbon dioxide, said method comprising:

providing a dye composition comprising carbon dioxide, a dye, and a surfactant, the surfactant included in an amount sufficient to solubilize, emulsify or disperse said dye in said carbon dioxide; wherein said carbon dioxide is a liquid or supercritical fluid; wherein said carbon dioxide is included in an amount of at least 30 percent by weight of said dye composition; and wherein said surfactant comprises a $CO_2$/Dye-philic surfactant; and then dyeing said dye substrate with said dye composition.

2. A method according to claim 1, wherein said dye is a disperse dye, and said dyeing step is a disperse dyeing step.

3. A method according to claim 2, wherein said substrate is polyester.

4. A method according to claim 2, wherein said substrate is a polyester and cotton blend.

5. A method according to claim 2, wherein said substrate is cellulose acetate.

6. A method according to claim 1, wherein said dye is an anionic dye, and said dyeing step is an anionic dyeing step.

7. A method according to claim 6, wherein said substrate is nylon.

8. A method according to claim 6, wherein said substrate is silk.

9. A method according to claim 6, wherein said substrate is wool.

10. A method according to claim 6, wherein said substrate is cotton.

11. A method according to claim 6, wherein said substrate is a cotton and polyester blend.

12. A method according to claim 6, wherein said substrate is rayon.

13. A method according to claim 7, 8, 9, 10, 11, or 12, said dye composition further comprising water.

14. A method according to claim 1, wherein said dye is a cationic dye, and said dyeing step is a cationic dyeing step.

15. A method according to claim 14, wherein said substrate is nylon.

16. A method according to claim 14, wherein said substrate is silk.

17. A method according to claim 14, wherein said substrate is wool.

18. A method according to claim 14, wherein said substrate is cotton.

19. A method according to claim 14, wherein said substrate is a cotton and polyester blend.

20. A method according to claim 14, wherein said substrate is rayon.

21. A method according to claim 15, 16, 17, 18, 19, or 20, said dye composition further comprising water.

22. A method according to claim 1, wherein said dye is a direct dye, and said dyeing step is a direct dyeing step.

23. A method according to claim 1, wherein said dye is an azoic dye, and said dyeing step is an azoic dyeing step.

24. A method according to claim 1, wherein said carbon dioxide is a liquid.

25. A method according to claim 1, wherein said carbon dioxide is a supercritical fluid.

26. A method according to claim 1, wherein said substrate is a textile substrate.

27. A method according to claim 1, wherein said dyeing step is followed by the step of drying said substrate.

28. A method of dyeing and surface treating a substrate in carbon dioxide, said method comprising:

providing a dye composition comprising carbon dioxide, a dye, a surfactant, and a surface treatment component, the surfactant included in an amount sufficient to solubilize, emulsify or disperse said dye in said carbon dioxide; wherein said carbon dioxide is a liquid or supercritical fluid; wherein said carbon dioxide is included in an amount of at least 30 percent by weight of said dye composition; wherein said surfactant comprises a $CO_2$/Dye-philic surfactant; and wherein said surface treatment component comprises a fluoropolymer or siloxane polymer; and then dyeing said substrate with said dye composition so that said substrate is dyed and said surface treatment component is deposited on the surface of said substrate.

29. A method according to claim 28, wherein said dye is a disperse dye, and said dyeing step is a disperse dyeing step.

30. A method according to claim 29, wherein said substrate is polyester.

31. A method according to claim 29, wherein said substrate is a polyester and cotton blend.

32. A method according to claim 29, wherein said substrate is cellulose acetate.

33. A method according to claim 28, wherein said dye is an anionic dye, and said dyeing step is an anionic dyeing step.

34. A method according to claim 33, wherein said substrate is nylon.

35. A method according to claim 33, wherein said substrate is silk.

36. A method according to claim 33, wherein said substrate is wool.

37. A method according to claim 33, wherein said substrate is cotton.

38. A method according to claim 33, wherein said substrate is a cotton and polyester blend.

39. A method according to claim 33, wherein said substrate is rayon.

40. A method according to claim 34, 35, 36, 37, 38 or 39, said dye composition further comprising water.

41. A method according to claim 28, wherein said dye is a cationic dye, and said dyeing step is a cationic dyeing step.

42. A method according to claim 41, wherein said substrate is nylon.

43. A method according to claim 41, wherein said substrate is silk.

44. A method according to claim 41, wherein said substrate is wool.

45. A method according to claim 41, wherein said substrate is cotton.

46. A method according to claim 41, wherein said substrate is a cotton and polyester blend.

47. A method according to claim 41, wherein said substrate is rayon.

48. A method according to claim 42, 43, 44, 45, 46 or 47, said dye composition further comprising water.

49. A method according to claim 28, wherein said dye is a direct dye, and said dyeing step is a direct dyeing step.

50. A method according to claim 28, wherein said dye is an azoic dye, and said dyeing step is an azoic dyeing step.

51. A method according to claim 28, wherein said carbon dioxide is a liquid.

52. A method according to claim 28, wherein said carbon dioxide is a supercritical fluid.

53. A method according to claim 28, wherein said substrate is a textile substrate.

54. A method according to claim 28, wherein said dyeing step is followed by the step of drying said substrate.

* * * * *